US008397449B2

(12) United States Patent
Yun

(10) Patent No.: US 8,397,449 B2
(45) Date of Patent: Mar. 19, 2013

(54) DOUBLE WINDOW HAVING VENTILATION FUNCTION

(75) Inventor: Byeong-Hee Yun, Chungcheongbuk-do (KR)

(73) Assignee: LG Hausys, Ltd. (KR)

( * ) Notice: Subject to any disclaimer, the term of this patent is extended or adjusted under 35 U.S.C. 154(b) by 43 days.

(21) Appl. No.: 12/810,936

(22) PCT Filed: Dec. 26, 2008

(86) PCT No.: PCT/KR2008/007718

§ 371 (c)(1),
(2), (4) Date: Jun. 28, 2010

(87) PCT Pub. No.: WO2009/084879

PCT Pub. Date: Jul. 9, 2009

(65) Prior Publication Data

US 2010/0281797 A1 Nov. 11, 2010

(30) Foreign Application Priority Data

Dec. 29, 2007 (KR) ..... 10-2007-0141103

(51) Int. Cl.
*E06B 7/14* (2006.01)

(52) U.S. Cl. ..... 52/209; 52/656.5; 52/204.593

(58) Field of Classification Search ..... 52/209, 52/204.5, 204.51, 204.52, 204.593, 204.6, 52/656, 656.6
See application file for complete search history.

(56) References Cited

U.S. PATENT DOCUMENTS

| | | | | |
|---|---|---|---|---|
| 217,630 | A * | 7/1879 | Maull | 454/211 |
| 4,627,206 | A * | 12/1986 | Cox | 52/209 |
| 4,691,487 | A * | 9/1987 | Kessler | 52/209 |
| 5,279,086 | A * | 1/1994 | Liao | 52/212 |
| 5,299,399 | A * | 4/1994 | Baier et al. | 52/204.52 |
| 5,675,948 | A * | 10/1997 | Boesch | 52/209 |
| 5,887,387 | A * | 3/1999 | Dallaire | 49/408 |
| 5,890,331 | A * | 4/1999 | Hope | 52/209 |
| 6,298,609 | B1 * | 10/2001 | Bifano et al. | 52/58 |
| 6,374,557 | B1 * | 4/2002 | O'Donnell | 52/209 |
| 6,883,279 | B2 * | 4/2005 | Fukuro et al. | 52/209 |
| 7,607,267 | B2 * | 10/2009 | Fulton et al. | 52/209 |
| 7,637,058 | B2 * | 12/2009 | Lai | 49/425 |
| 7,647,735 | B2 * | 1/2010 | Kristensen | 52/200 |
| 2007/0062132 | A1 * | 3/2007 | Kristensen | 52/209 |
| 2007/0240372 | A1 * | 10/2007 | Buhlmann et al. | 52/209 |
| 2009/0313922 | A1 * | 12/2009 | Yun | 52/209 |

FOREIGN PATENT DOCUMENTS

| | | |
|---|---|---|
| CN | 2806725 Y | 8/2006 |
| GB | 2174745 | 11/1986 |
| JP | 8303138 | 11/1996 |
| KR | 20-0377212 | 3/2005 |

(Continued)

*Primary Examiner* — Joshua J Michener
*Assistant Examiner* — Alp Akbasli
(74) *Attorney, Agent, or Firm* — Baker & Hostetler LLP

(57) ABSTRACT

The present invention relates to a double layered window having indoor and outdoor windows. There is provided a double layered window in which a ventilation device or a ventilation hole is formed in window frame to control temperature and moisture of an intermediate layer, thereby preventing dew condensation, and in a case where the double layered window is installed to an outer wall of a high-story building, the intermediate layer between the indoor and outdoor windows is used as an air pressure buffering space, thereby preventing a problem caused by an air pressure difference.

4 Claims, 7 Drawing Sheets

FOREIGN PATENT DOCUMENTS

| | | |
|---|---|---|
| KR | 10-2005-0072216 | 7/2005 |
| KR | 10-2005-0111145 | 11/2005 |
| KR | 20-0436719 | 9/2007 |
| RU | 2235842 | 9/2004 |

* cited by examiner

DOUBLE WINDOW HAVING VENTILATION FUNCTION

TECHNICAL FIELD

The present invention relates to a double layered window, and more particularly, to a double layered window configured to naturally introduce external air into a space defined between indoor and outdoor windows without opening the outdoor window.

BACKGROUND ART

Generally, a curtain wall or a double layered window composed of indoor and outdoor windows is installed to an apartment building or a mixed-use residential building.

In particular, a double layered window has advantages of ensuring insulation and sound absorption. However, as construction of a balcony expansion is legalized, general consumers prefer double layered windows or double curtain walls in which a gap between indoor and outdoor windows is decreased, in order to ensure a wide indoor area.

FIG. 1 is a schematic view showing a structure of a general double layered window. A conventional double layered window includes a window frame 10 fixed to a wall (not shown), sash frames 20 and 30 installed to the window frame 10, and an indoor window 40 and an outdoor window 50 respectively installed to the sash frames 20 and 30, and a predetermined space 60 is defined between the indoor window 40 and the outdoor window 50.

A double layered window having the narrow space 60 between the indoor window 40 and the outdoor window 50 has advantages in that the excellent insulation performance and sound absorption can be maintained and a wide indoor area can also be ensured. However, in winter, a large amount of dew water 70 (see FIG. 1) is condensed on an inner side (a side toward an indoor area) of the outdoor window 50 due to a great difference between indoor temperature and outdoor temperature.

The dew water may be introduced into a room through a gap between the indoor window 40 and the sash frame 20, and the dew water introduced into the room causes various problems such as must, stain, dirt, and frost. Also, the dew water generated on the window disturbs a field of view from the indoor area to the outside.

Particularly, there is a disadvantage in that in order to solve this problem occurring in the space 60 between the indoor window 40 and the outdoor window 50, the indoor window 40 or the outdoor window 50 should be frequently open for ventilation in the double layered window.

DISCLOSURE

Technical Problem

The present invention is conceived to solve the aforementioned problems. An object of the present invention is to provide a double layered window having a ventilation hole for naturally introducing external air into a space between indoor and outdoor windows and thus preventing dew condensation without opening the indoor window or the outdoor window.

Technical Solution

According to an aspect of the present invention for achieving the objects, there is provided a double layered window, which comprise a plurality of vertical frames and a horizontal window frame; and outdoor and indoor windows openably installed to each of regions defined by the horizontal window frame and the vertical window frames, the outdoor and indoor windows being spaced apart from each other to define a space therebetween.

At this time, a ventilation means is preferably formed in the horizontal window frame such that external air is introduced into the space between the indoor and outdoor windows through the ventilation means.

Here, the ventilation means preferably includes a through-hole formed in one side of the horizontal window frame corresponding to the space between the outdoor and indoor windows, an opening formed in one side of the horizontal window frame corresponding to the outside, and a flow passage connecting the opening with the through hole.

In the double layered window according to one aspect of the present invention, preferably, the vertical window frames comprise both outer vertical window frames and inner vertical window frames, and one or more ventilating openings are formed in the inner vertical window frames.

At this time, the ventilating openings may be formed in upper and lower portions of the inner vertical window frame, and preferably, the ventilating opening connects the space between the indoor and outdoor windows in one region to the space between the indoor and outdoor windows in the adjacent regions.

At this time, preferably, wherein the inner vertical window frames having the ventilating openings formed in upper end portions thereof and the inner vertical window frames having the ventilating openings formed in lower end portions thereof are disposed alternatively.

Advantageous Effects

As described above, a double layered window according to the present invention has an advantage in that a ventilation structure or a ventilation hole is provided at a horizontal window frame such that external air may circulate in a space between indoor and outdoor windows, thereby naturally controlling temperature and moisture of the space and thus preventing dew condensation, and a horizontal cross-ventilation unit is formed in a vertical window frame so that an openable window may not be installed to every region.

In addition, there is an effect in that the space is used as an air pressure buffering space to thereby prevent a problem caused by a difference in air pressure.

BEST MODE

Hereinafter, the double layered window according to preferred embodiment of the present invention will be described in detail with reference to the accompanying drawings.

Figure 1:
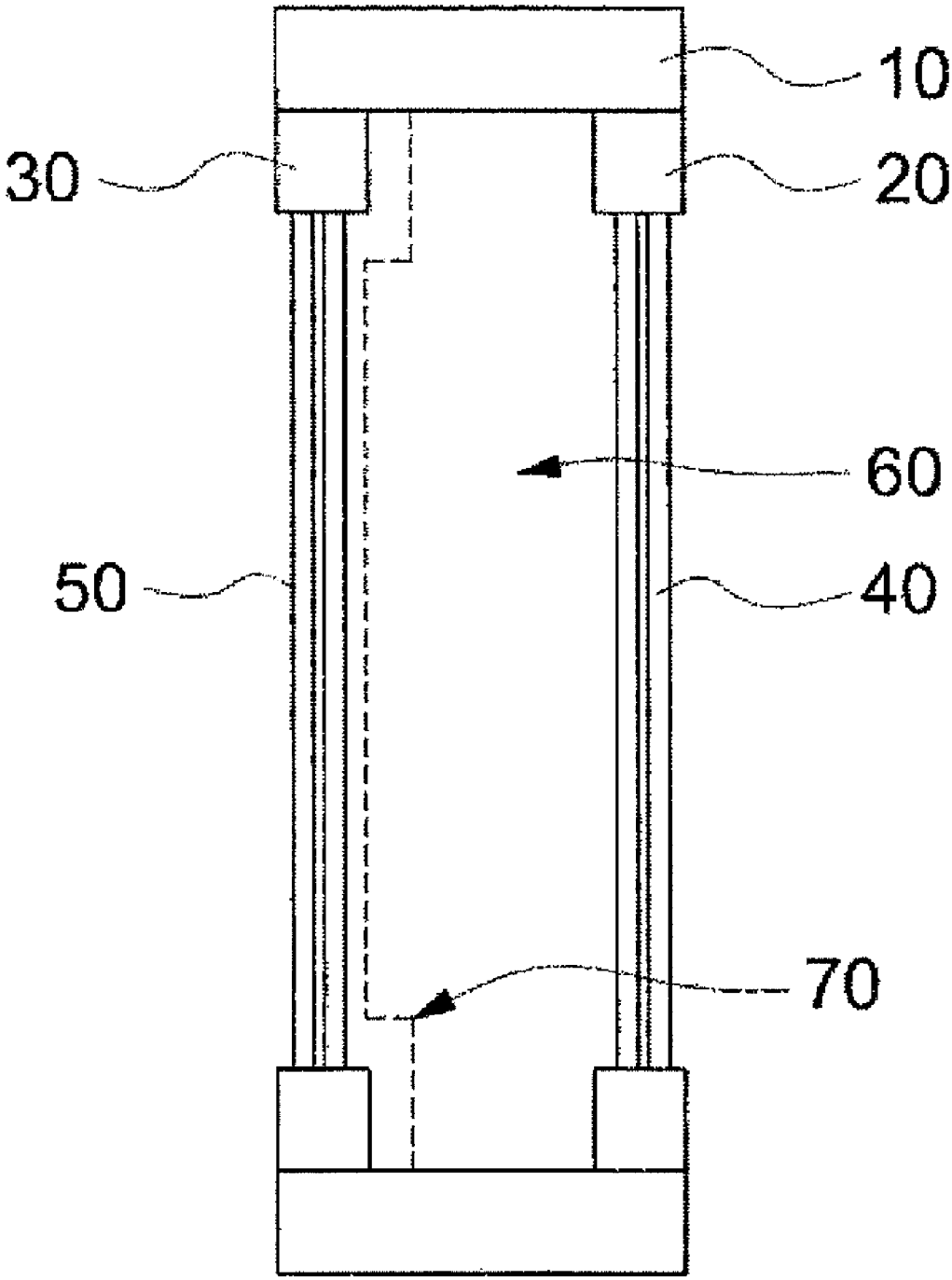
FIG. 1 is a schematic view of a conventional double layered window.
Figure 2:
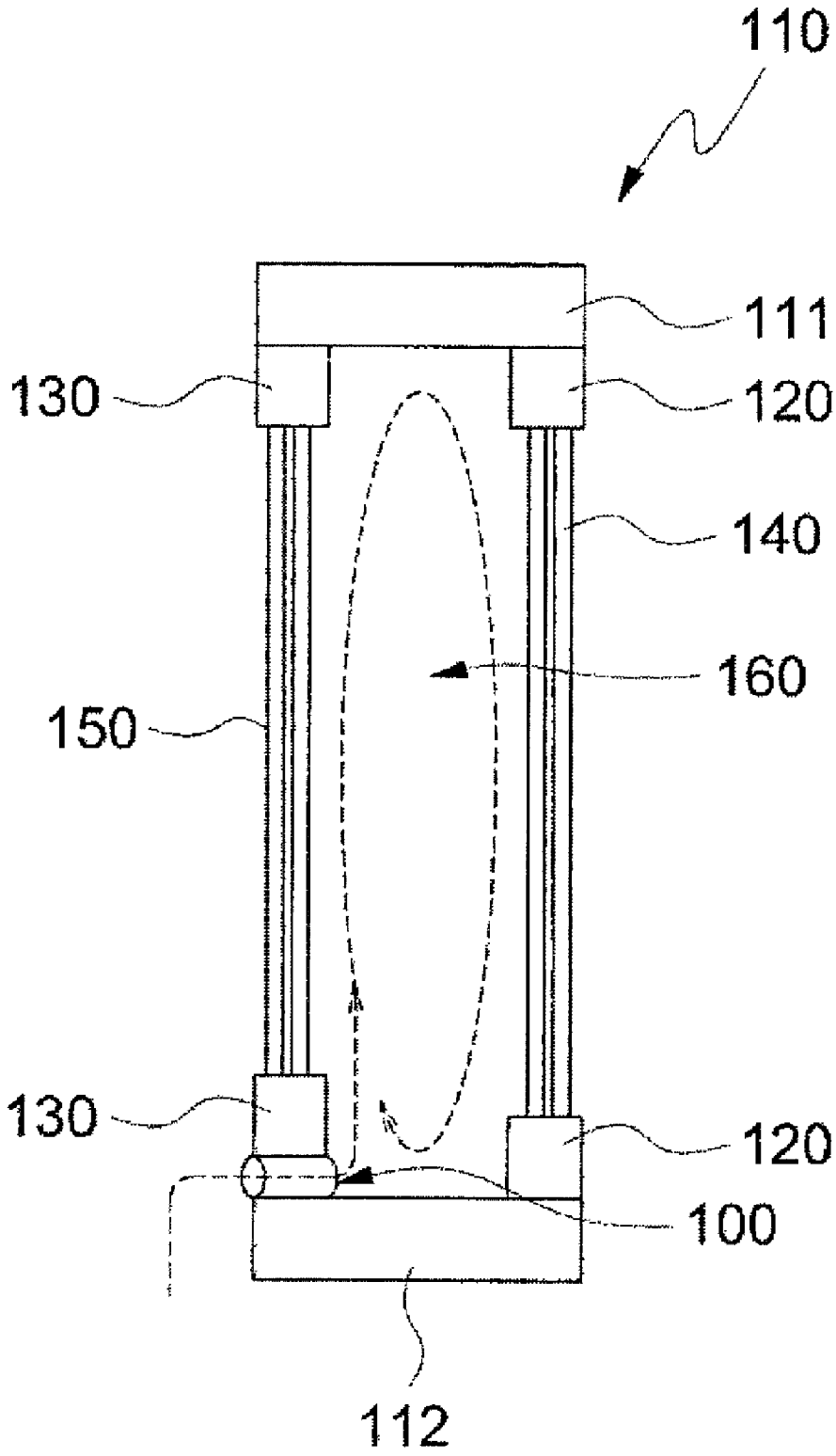
FIG. 2 is a schematic view of a double layered window according to one embodiment of the present invention.

FIG. 2 is a schematic view showing the configuration of a double layered window according to one embodiment of the present invention. The double layered window includes a window frame 110 fixed to a wall (not shown), sash frames 120 and 130 installed to the window frame 110, and an indoor window 140 and an outdoor window 150 respectively installed to the sash frames 120 and 130.

Here, the window frame 110 may be composed of upper and lower horizontal window frames 111 and 112, and two vertical window frames (not shown) respectively fixed to both end portions of the upper horizontal window frame 111 and the lower horizontal window frame 112.

Meanwhile, a space 160 defined between the indoor window 140 and the outdoor window 150 is maintained to be airtight by a closed state of the indoor window 140 and the outdoor window 150.

The double layered window according to the embodiment of the present invention includes a ventilation means 100 formed at the window frame 110 for supporting the outdoor window 150 such that external air may be introduced into the space 160 between the indoor window 140 and the outdoor window 150.

The external air introduced into the space 160 between the indoor window 140 and the outdoor window 150 circulates in the space 160 through the ventilation means 100 due to a convection phenomenon, and thus, dew condensation caused by a temperature difference between the space 160 and the outside does not occur on the outdoor or indoor window.

The configuration and function of such a ventilation means 100 will be specifically described.

Figure 3:
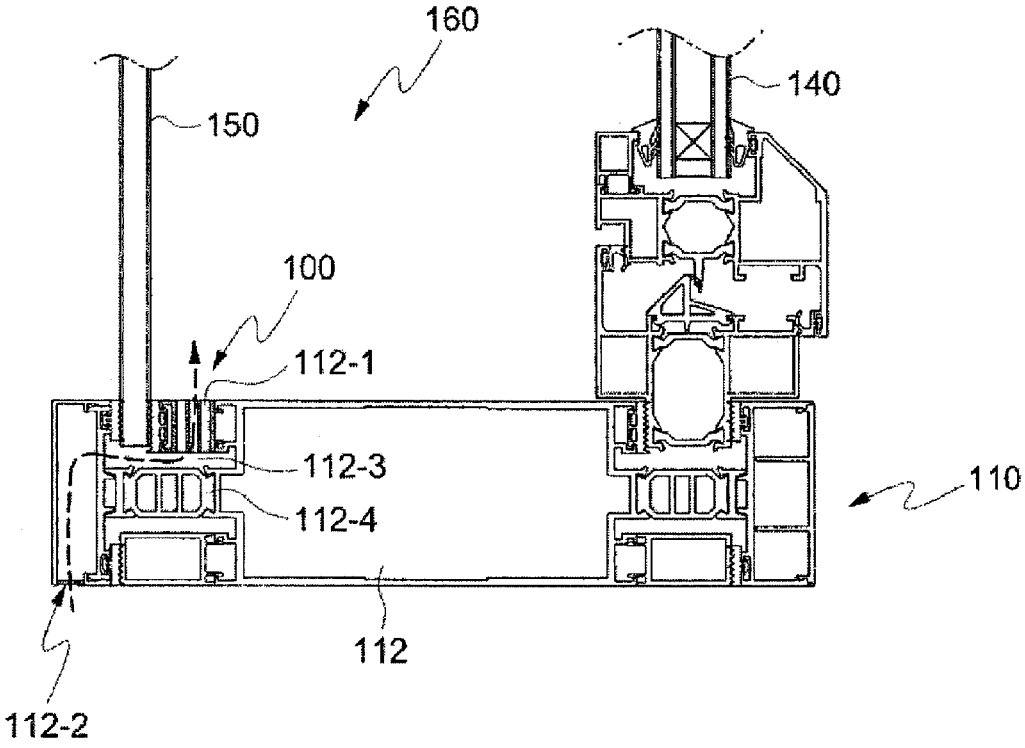
FIG. 3 is a sectional view of a horizontal window frame of a double layered window according to one embodiment of the present invention.
Figure 4:
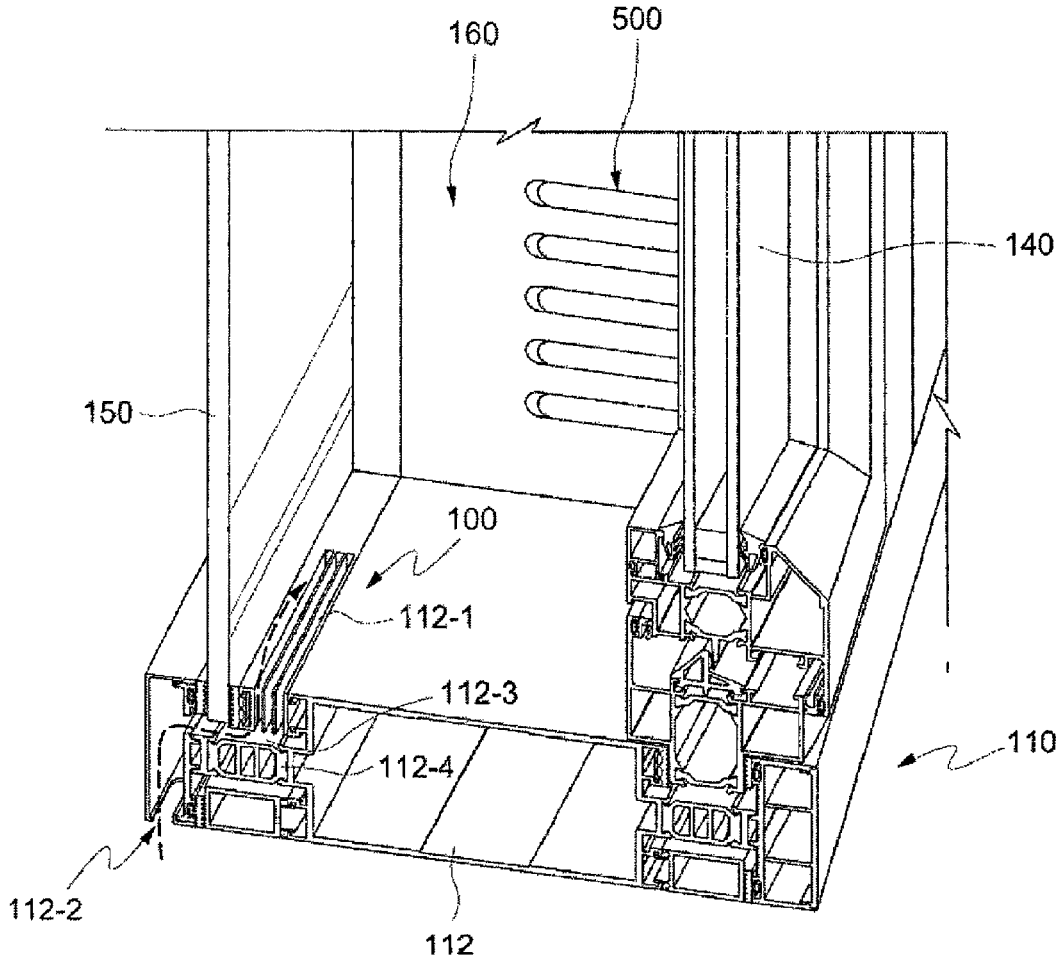
FIG. 4 is a partially sectional perspective view of a double layered window according to one embodiment of the present invention.
Figure 5:
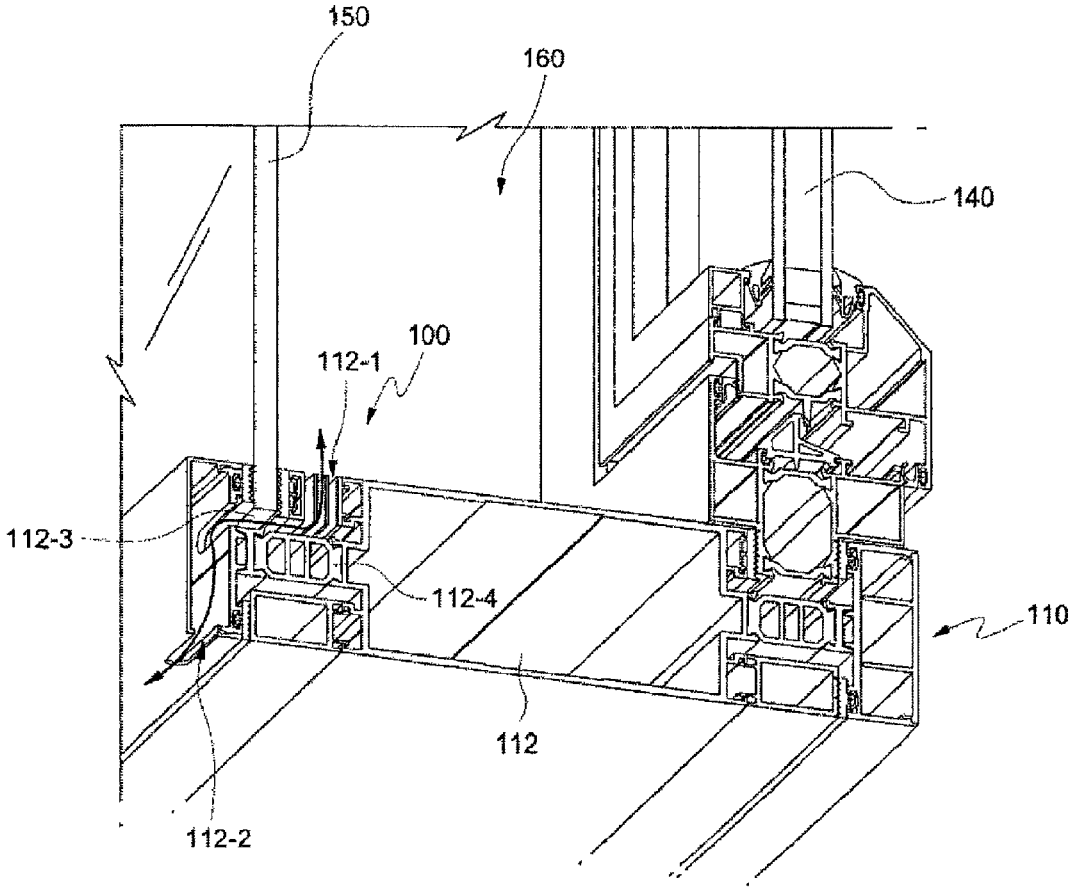
FIG. 5 is a view corresponding to FIG. 4 and a bottom perspective view showing the double layered window of FIG. 4.

FIG. 3 is a sectional view showing a horizontal window frame formed with the ventilation means of the double layered window according to the embodiment of the present invention, and FIGS. 4 and 5 are partially sectional perspective views of the horizontal window frame formed with the ventilation means of the double layered window according to the embodiment of the present invention, wherein FIG. 4 shows the horizontal window frame as viewed from top and FIG. 5 shows the horizontal window frame as viewed from bottom.

Meanwhile, arrows shown in FIGS. 3, 4 and 5 indicate the flow of air introduced into the space between the outdoor and indoor windows from the outside through the ventilation means 100.

The ventilation means 100 of the double layered window according to the embodiment of the present invention is formed in a horizontal window frame, for example the lower horizontal window frame 112. Specifically, the ventilation means 100 may include a through-hole 112-1 formed in one side of a horizontal window frame 102 corresponding to the space between the outdoor window 150 and the indoor window 140, an opening 112-2 formed in one side of the horizontal window frame 102 corresponding to the outside, and a flow passage 112-3 for connecting the opening with the through hole. Thus, the space 160 is communicated with the outside through the through-hole 112-1, the flow passage 112-3 and the opening 112-2.

Meanwhile, although it is illustrated in FIGS. 3, 4 and 5 that the through-hole 112-1 has a slit shape with predetermined length, the present invention is not limited thereto.

The through-hole 112-1 so configured corresponds to the space 160 between the outdoor window 150 and the indoor window 140, and thus, the external air is introduced into the space 160 through the flow passage 112-3 and the through-hole 112-1 of the ventilation means 100 (as indicated by the arrows).

The external air introduced from the outside through the ventilation means 100 as mentioned above allows temperature and moisture in the space 160 to be naturally controlled, thereby making it possible to prevent dew water from being condensed on the indoor window or the outdoor window.

Meanwhile, the ventilation means employed in the present invention is installed to a double layered window or curtain wall installed at an outer wall of a high-story building, so that the space between the outdoor window and the indoor window may function as an air pressure buffering space. Thus, the space may prevent a problem caused by an air pressure difference between the outside and the indoor area in advance.

Hereinafter, a flow path of external air introduced through the ventilation means will be described in more detail.

In FIG. 5, the flow passage 112-3 of the ventilation means 100 may be formed in an upper portion of a gasket 112-4 installed in the lower horizontal window frame 112 of the window frame 110, and the through-hole 112-1 may be formed in the lower horizontal window frame 112 of the window frame 110 corresponding to the space 160.

Meanwhile, one end of the flow passage 112-3 is communicated with the opening 112-2 formed in one side of the lower horizontal window frame 112, so that the flow passage 112-3 may be communicated with the outside (the atmosphere).

The external air introduced through the opening 112-2 formed in the lower horizontal window frame 112 of the window frame 110 is introduced into the space 160 between the outdoor window 150 and the indoor window 140 through the flow passage 112-3 in the lower horizontal window frame 112 and the through-hole 112-1 formed in the lower horizontal window frame 112.

In the double layered window having the ventilation means 100 so configured, even in a closed state of the outdoor door 150, the external air may be introduced into the space 160 between the outdoor window 150 and the indoor window 140. Thus, even in a case where a user does not open the indoor window 140 and the outdoor window 150, the external air may be introduced into the space 160 defined between the indoor window 140 and the outdoor window 150 through the ventilation means 100, and accordingly, dew condensation caused by a temperature difference between the space 160 and the outside does not occur.

Meanwhile, the number of the ventilation means 100 having the above function, the shape and number of through-holes may be changed according to the size of a window.

Although a double layered window having a single sash frame installed to a window frame has been described as an example, the present invention is not limited thereto. For example, a window frame having a plurality of sash frames such as a curtain wall may be employed.

Figure 6:
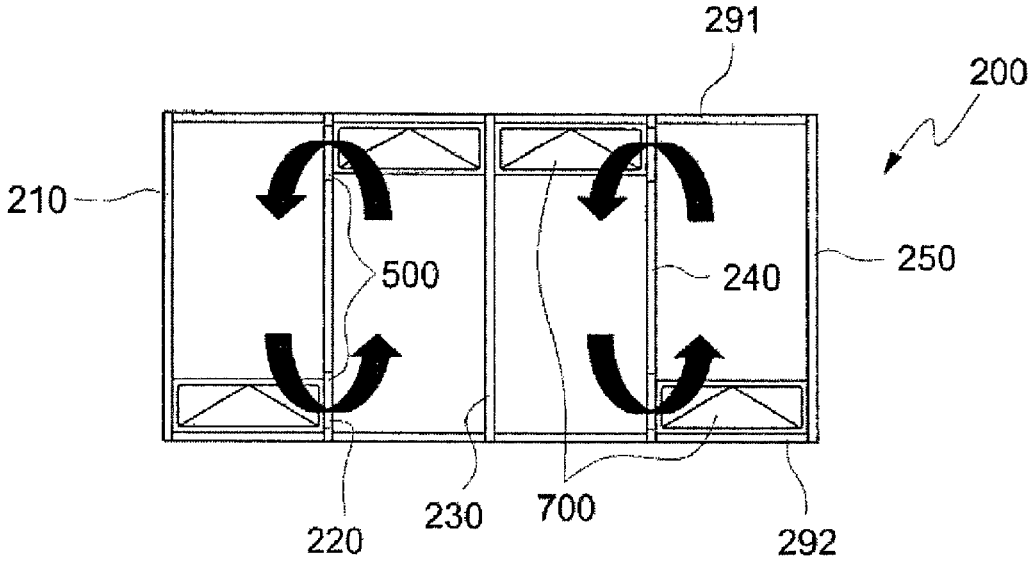
FIGS. 6 to 8 are views illustrating various applications of a double layered window according to other embodiments of the present invention.
Figure 7:
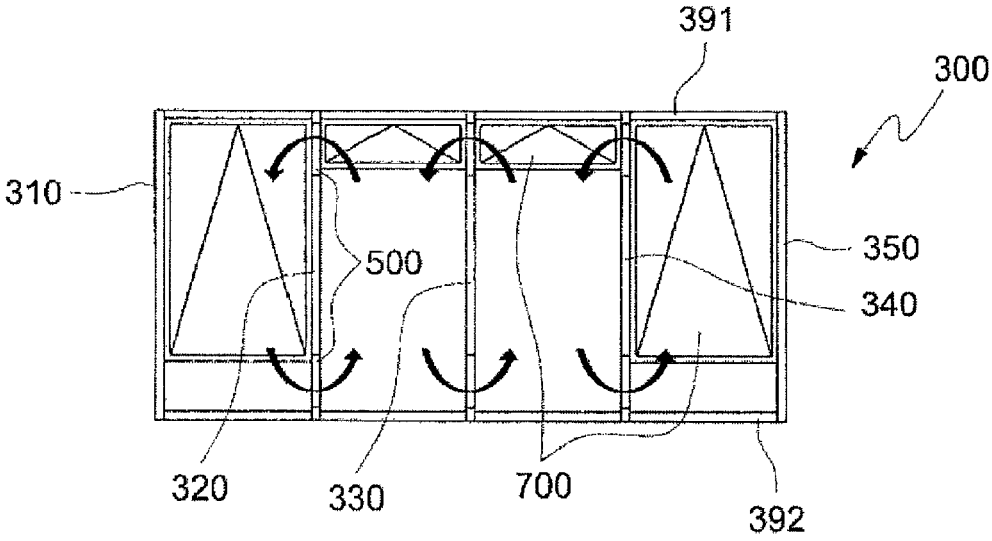
Figure 8:
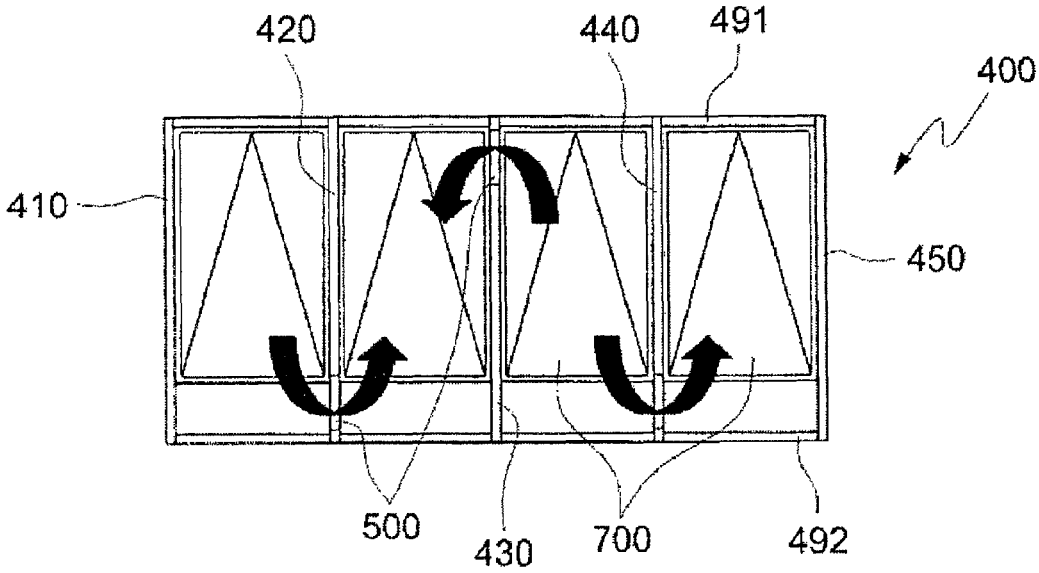

FIGS. 6 to 8 show a double layered window (or a curtain wall) having a plurality of sash frames installed to a single window frame.

The window frame comprises upper and lower horizontal window frames and a plurality of vertical window frames fixed to the upper and lower horizontal frames, wherein such horizontal and vertical window frames may divide the window frame into a plurality of regions in which sash frames are respectively mounted. As mentioned above, an outdoor window and an indoor window are mounted to each region defined by the upper and lower horizontal window frames and two of the vertical window frames.

In the double layered window so configured, the ventilation means 100 illustrated in FIGS. 2 to 5 may be formed at the lower horizontal window frame corresponding to each region.

Each ventilation means may correspond to a space between indoor and outdoor windows mounted to each region. The ventilation means has the same configuration and function as that illustrated in FIGS. 2 to 5, and accordingly, overlapping descriptions thereof will be omitted.

Meanwhile, the ventilation means need not be installed to every region of the window frame. For example, a ventilating opening 500 (see FIG. 4) is formed in the vertical window frame dividing two adjacent regions from each other to allow the spaces (between outdoor and indoor windows) of both the regions to be communicated with each other and the ventilation means is formed only in the lower horizontal window frame at any one of both the regions, whereby the effects obtained by the double layered window illustrated in FIGS. 2 to 5 can be identically obtained in all the regions of the window frame.

FIGS. 6 to 8 show air flow in the double layered window in which the ventilation means is formed only in the lower horizontal window frame at some regions and horizontal ventilating opening are formed in the vertical window frames. Air flows in the direction of arrows passing through the horizontal cross-ventilation unit in each application. Here, FIGS. 6 to 8 illustrate the outdoor window of the window frame, as observed not from the indoor area but from the outside. When the outdoor window is installed, the indoor window may be installed as one openable window or divided into two areas among which one area is formed as a fixed window and the other area is formed as an openable window.

The applications illustrated in FIGS. 6 to 8 will be described. It would be understood that upper and lower openable windows need not be installed to each region divided by the vertical window frame since the horizontal cross-ventilation unit is formed in the vertical window frame, which may reduce installation costs in comparison to a conventional window structure in which openable windows should be installed to upper and lower portions of a vertical window frame.

FIG. 6 shows that ventilating openings 500 are formed in upper and lower portions of a vertical window frame 220, and no ventilating opening is formed in an adjacent vertical window frame 230. Here, the ventilation means 100 illustrated in FIGS. 2 to 5 is formed in a lower horizontal window frame 292 in any one of regions divided by the vertical window frame 220 or 240 having the ventilating opening 500, except for outmost vertical window frames 210 and 250.

In the double layered window so configured, air introduced from the outside through the single ventilation means circulates in two spaces (between indoor and outdoor windows) of adjacent two regions.

Meanwhile, in a case where no ventilation means is provided at the lower horizontal window frame 292, external air can be introduced into spaces of two regions if an openable window 700 is formed only in an outdoor window in any one of two regions.

FIG. 7 shows that ventilating openings are installed to upper and lower portions of all vertical window frames 320, 330 and 340 of a window frame 300, except for outermost vertical window frames 310 and 350 thereof.

In this configuration, spaces (between outdoor and indoor windows) of all regions are communicated with each other through the ventilating openings, so that external air introduced through a ventilation means formed in a lower horizontal window frame 392 of any one region may circulate in the spaces of all the regions.

Meanwhile, in a case where no ventilation means is configured in the lower horizontal window frame 392, the external air may be introduced into the spaces of all the regions if an openable window is formed only in an outdoor window of any one region.

FIG. 8 shows a configuration 400 in which a ventilating opening is formed in a lower portion of any one vertical window frame 420 or 440, and another ventilating opening is formed in an upper portion of an adjacent vertical window frame 430. Even in this configuration, spaces (between outdoor and indoor windows) of all regions may be communicated with each other through the ventilating openings, and thus, external air introduced through a ventilation means formed in a lower horizontal window frame 492 of any one region may circulate in the spaces of all the regions.

Meanwhile, in a case where no ventilation means is formed in the lower horizontal window frame 492, the external air may be introduced into the spaces of all the regions if an openable window 700 is formed only in an outdoor window of any one region.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and appended claims. In addition to variations and modifications in the component parts and/or arrangements, alternative uses will also be apparent to those skilled in the art.

The invention claimed is:

1. A double layered window, comprising:

a plurality of vertical frames and a horizontal window frame containing a gasket and an opening formed on one side of the horizontal window frame corresponding to the outside of the horizontal window frame; and a plurality of outdoor and indoor windows, each pair of the outdoor and indoor windows installed to a plurality of regions defined by the horizontal window frame and the vertical window frames, with each of said regions being adjacent to one another and with each pair of the outdoor and indoor windows being spaced apart from each other to define a space therebetween, and ventilation means formed in the gasket of the horizontal window frame such that external air is introduced into the space between the indoor and outdoor windows through the ventilation means and gasket, wherein the ventilation means comprises a through-hole formed in one side of the horizontal window frame corresponding to the space between the outdoor and indoor windows, and with the gasket having a flow passage interconnecting the opening in the horizontal window frame with the through-hole of the ventilation means.

2. The double layered window as claimed in claim 1, wherein the vertical window frames comprise both outer vertical window frames and a plurality of inner vertical window frames, and one or more ventilating openings are formed in the inner vertical window frames wherein the ventilating opening in the inner vertical window frames connects the space between the indoor and outdoor windows in one region to the space between the indoor and outdoor windows adjacent regions.

3. The double layered window as claimed in claim 2, wherein the ventilating openings are formed in upper and lower portions of the inner vertical window frame.

4. The double layered window as claimed in claim 2, wherein the inner vertical window frames having the ventilating openings formed in upper end portions thereof and the inner vertical window frames having the ventilating openings formed in lower end portions thereof are disposed alternatively.

* * * * *